US010893756B1

(12) United States Patent
Neuenswander

(10) Patent No.: US 10,893,756 B1
(45) Date of Patent: Jan. 19, 2021

(54) FOLDABLE LEG ASSEMBLY WITH SCREW FEATURE FOR BEDDING OR FURNITURE

(71) Applicant: L&P Property Management Company, South Gate, CA (US)

(72) Inventor: Jacob J. Neuenswander, Carthage, MO (US)

(73) Assignee: L & P Property Management Company, South Gate, CA (US)

( * ) Notice: Subject to any disclaimer, the term of this patent is extended or adjusted under 35 U.S.C. 154(b) by 10 days.

(21) Appl. No.: 16/522,700

(22) Filed: Jul. 26, 2019

(51) Int. Cl.
*A47C 19/12* (2006.01)
*A47B 3/08* (2006.01)

(52) U.S. Cl.
CPC ..... *A47C 19/128* (2013.01); *A47B 3/08* (2013.01); *A47B 2003/0824* (2013.01)

(58) Field of Classification Search
CPC .. A47C 19/128; A47B 3/08; A47B 2003/0824
USPC ..... 248/188.6; 108/125, 127, 160
See application file for complete search history.

(56) References Cited

U.S. PATENT DOCUMENTS 1,342,951 A * 6/1920 Gagne ..... A47B 3/0818 248/151
2,145,734 A * 1/1939 Rastetter ..... A47B 3/0812 108/125
2,660,498 A * 11/1953 Norquist ..... A47B 3/0812 108/125
2,838,353 A * 6/1958 Emmert ..... A47B 3/0812 403/61
2,845,316 A * 7/1958 Bailey ..... A47B 3/08 108/127
6,536,358 B1 * 3/2003 Fears ..... A47B 3/08 108/116
6,659,021 B2 * 12/2003 Wen ..... A47B 3/0915 108/125
2003/0172855 A1 * 9/2003 Wen ..... A47B 3/0915 108/125
2005/0172868 A1 * 8/2005 Cattaneo ..... A47B 3/0809 108/127
2010/0218670 A1 * 9/2010 Keng ..... F16M 11/16 89/37.04

* cited by examiner

*Primary Examiner* — Muhammad Ijaz
(74) *Attorney, Agent, or Firm* — Wood Herron & Evans LLP

(57) ABSTRACT

A bedding or furniture product comprises a foldable leg assembly movable between a folded position for storage or shipping the product and a locked position for supporting the product in use. The foldable leg assembly comprises a threaded connector adapted to be securable to a frame of the product and a linkage member pivotally coupled to the threaded connector to form a pivot joint therebetween. The leg assembly further comprises a leg member coaxially coupled to the linkage member and slideable therealong. The leg member has a threaded inner surface adjacent to an upper end configured to be threadably coupled to the threaded connector.

20 Claims, 11 Drawing Sheets

FOLDABLE LEG ASSEMBLY WITH SCREW FEATURE FOR BEDDING OR FURNITURE

FIELD OF THE INVENTION

This invention relates generally to furniture and bedding products and, more particularly, to supporting legs of the folding type for use with such products.

BACKGROUND OF THE INVENTION

Conventional bedding products often have a rectangular frame comprising two opposed side rails with a plurality of cross support members, or slats, extending across the side rails for supporting a box spring or foundation. Bed frames, for example, may further include several other components such as support leg assemblies which are usually secured to the side rails or cross members to support the bed frame about the floor. Such bed frames are typically manufactured and shipped to various retail outlets for offering to end consumers.

Accordingly, manufacturers attempt to package the bed frames in an efficient and cost-effective manner. This often requires that various components of the bed frames be packaged in an unassembled state such that subsequent assembly is required before the consumer may use the bed frame. By way of example, the support legs may not come assembled to the bed frame. As a result, the practice of shipping such components separately, in an unassembled state, involves considerable amounts of time and cost for both the manufacturer and end-user.

Conventional assembly of a bed frame, for example, often requires hardware and tools, such as wrenches, screw drivers, etc. Accordingly, proper assembly relies on the retailer or consumer having the proper tools readily accessible. It can be frustrating when the person starts assembling the bed frame but then learns that they lack the proper tools required to complete the assembly. Moreover, proper assembly of the bed frame may be dependent on the skill set of the person performing the assembly. Thus, even with the correct tools, proper assembly of the bed frame may not be achieved. The improper assembly of the bed frame may frustrate the customer and result in negative product perception, phone calls or other communications from unsatisfied consumers, or product return and a demand for a refund.

In view of the above, there is an increasing need for manufacturers to provide bedding or furniture products that are easy to assemble and require a minimum number of tools.

It is therefore an objective of this invention to provide a bedding or furniture product which may be shipped in a partially assembled state with the leg assemblies pre-attached to the bedding or furniture frame and configured to be assembled in a tool-less manner.

It is further an objective of this invention to provide a bedding or furniture product having legs, where each leg is foldable between a folded position for shipping and storage and a locked position for use.

SUMMARY OF THE INVENTION

According to one aspect of the invention, a foldable leg assembly for use in a bedding or furniture product, such as a bed frame or table, may be movable between a folded position and a locked position. The leg assembly comprises a threaded connector configured to be secured to a member of a frame which may be part of the bedding or furniture product. The leg assembly further includes a linkage member pivotally coupled to the threaded connector to form a pivot joint therebetween, the pivot joint having a pivot axis. The threaded connector may be secured to the member of the frame with at least one fastener or in any known manner.

The leg assembly further comprises a leg member coaxially coupled to the linkage member to define a linkage assembly. The leg member is rotatable and slideable relative to the linkage member. The leg member has a threaded inner surface adjacent to an upper end and configured to threadably couple to the threaded connector. The foldable leg assembly is movable between a locked position and a folded position. The threaded connector of the leg assembly is stationary relative to the member of the frame regardless of the position of the leg assembly. The leg member of each foldable leg assembly includes a cavity configured to telescopically receive the linkage member, pivot joint, and a portion of the threaded connector therein.

When the leg assembly is in the locked position, the leg member is threadably coupled to the threaded connector such that the upper end of the leg member abuts the frame. When so positioned, the linkage member, pivot joint, and a portion of the threaded connector are disposed within a cavity of the leg member. When the leg assembly is in the folded position, a portion of the linkage member is disposed within a cavity of the leg member and the linkage assembly is pivoted about the pivot axis of the pivot joint to a position substantially parallel to the member of the frame.

The threaded connector includes a boss extending from the threaded connector in an axial direction and the linkage member includes a split connector configured to receive the boss and be pivotally coupled thereto. The linkage member and threaded connector are pivotally coupled together with a pivot pin. The linkage assembly pivots at least 90 degrees about the pivot axis of the pivot joint.

In another aspect of the invention, the foldable leg assembly for use in a bedding or furniture product comprises a threaded connector having a cylindrical body provided with threads. The threaded connector further includes an upper end extending in an axial direction away from the cylindrical body and a boss extending in an opposite axial direction and diametrically opposed from the upper end. The threaded connector is adapted to be secured to a member of a frame which may be part of the bedding or furniture product.

The leg assembly further comprises a linkage member having a cylindrical base with a body extending in an axial direction therefrom to a split connector. The split connector includes two arms defining a notch configured to receive the boss of the threaded connector such that the boss and split connector may be pivotally coupled together via a pivot pin to form a pivot joint therebetween, the pivot joint having a pivot axis. The linkage member further includes an annular flange configured to abut a shoulder of the leg member as described below.

The foldable leg assembly further comprises a leg member coaxially coupled to the linkage member to define a linkage assembly. The leg member is rotatable and slideable relative to the linkage member and includes a threaded inner surface adjacent to an upper end and configured to threadably couple to the threaded connector such that the foldable leg assembly is movable between a locked position and a folded position. The leg member further includes a lower end having an inner surface adjacent to the lower end. The threaded inner surface adjacent to the upper end and inner surface adjacent to the lower end are separated by a shoulder. The shoulder of the leg member is configured to abut the annular flange of the linkage member to limit movement of the leg member relative to the linkage member.

According to another aspect of the invention, a method of assembling a furniture or bedding product, such as a table or bed frame, comprises providing a foldable leg assembly having a threaded connector secured to a member of a frame, which may be part of the bedding or furniture product. The method further includes providing a linkage member pivotally coupled to the threaded connector to form a pivot joint therebetween, the pivot joint having a pivot axis. The method further includes providing a leg member rotatably and slideably coupled to the linkage member in a coaxial arrangement to define a linkage assembly. The leg member has a threaded inner surface adjacent to an upper end and is configured to threadably couple to the threaded connector.

The method comprises pivoting the linkage assembly from a folded position wherein the linkage member is substantially parallel to the member of the frame about the pivot axis of the pivot joint to align an axis of the linkage assembly with an axis of the threaded connector. The step of pivoting the linkage assembly about the pivot axis of the pivot joint includes pivoting the linkage assembly at least 90 degrees about the pivot axis of the pivot joint.

The next step comprises sliding the leg member upwardly towards the threaded connector secured to the member of the frame to overlap a portion of the linkage member and a portion of the threaded connector. The leg member is then rotated about the threaded connector until the upper end of the leg assembly abuts the member of the frame, thereby threadably coupling the leg member to the threaded connector and the member of the frame. The step of sliding the leg member upwardly towards the threaded connector secured to the member of the frame includes telescopically receiving the linkage member, a portion of the threaded connector, and pivot joint within a cavity of the leg member.

The accompanying drawings, which are incorporated in and constitute part of this specification, illustrate embodiments of the invention and, together with the summary of the invention given above, and the detailed description of the drawings given below, explain the principles of the present invention.

DETAILED DESCRIPTION OF THE INVENTION

Aspects of the present invention are directed to a foldable leg assembly for use with bedding or furniture products. Additional, aspects of the invention are directed to a toolless assembly and disassembly of the foldable leg assembly. FIGS. 1-6D illustrate a bedding product having four foldable leg assemblies in accordance with an embodiment of the invention. FIGS. 7-10 illustrate a furniture product in the form of a table having four foldable leg assemblies in accordance with another embodiment of the invention. However, while aspects of the present invention will be described herein in the context of specific bedding and furniture products, it should be appreciated that other products requiring leg assemblies such as chairs, couches, or the like, may also benefit from aspects of the invention. The drawings are not intended to be limiting.

Figure 1:
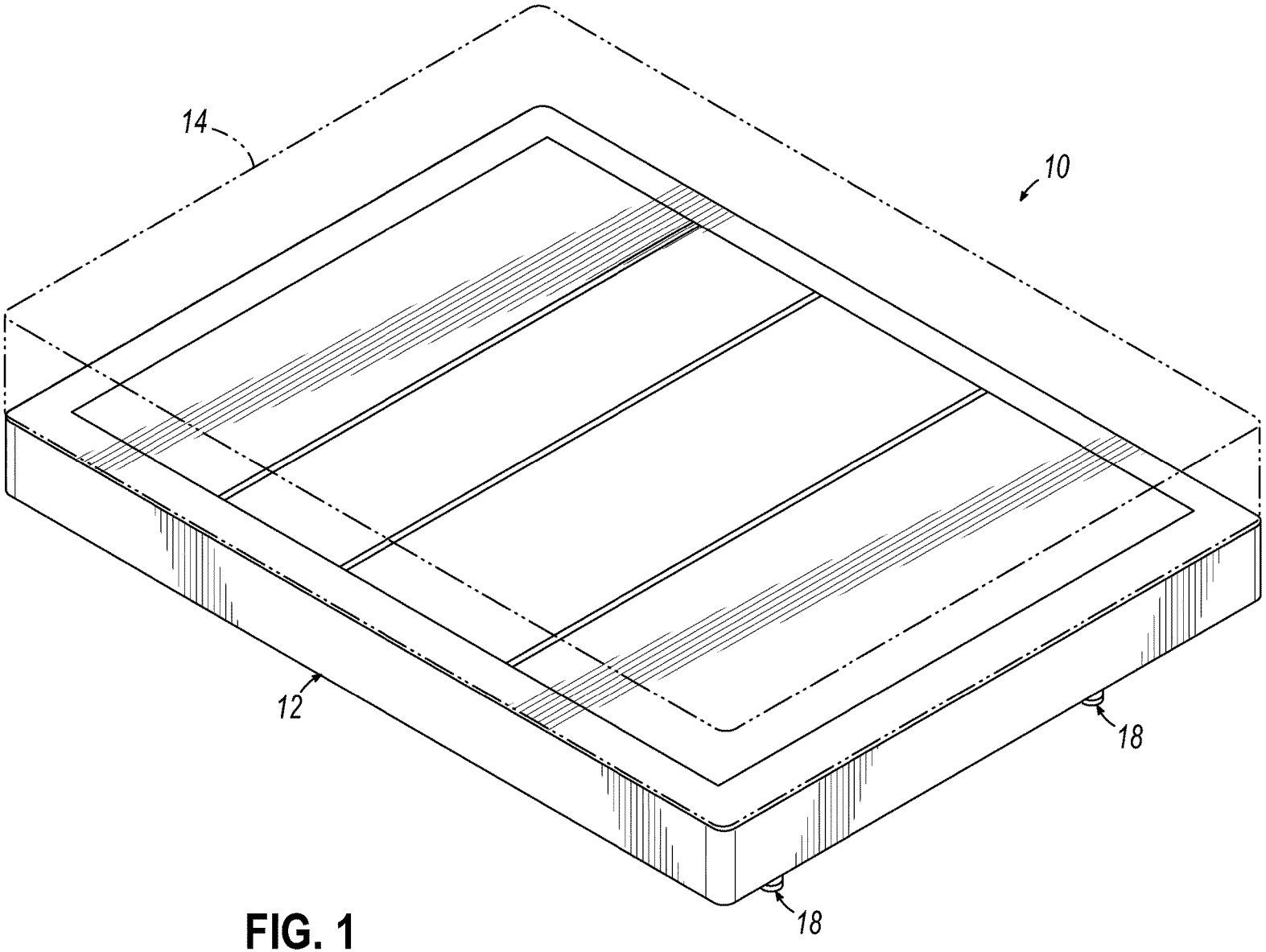
FIG. 1 is a perspective view of a bedding product having foldable leg assemblies, in the form of a bedding foundation fully assembled.
Figure 2:
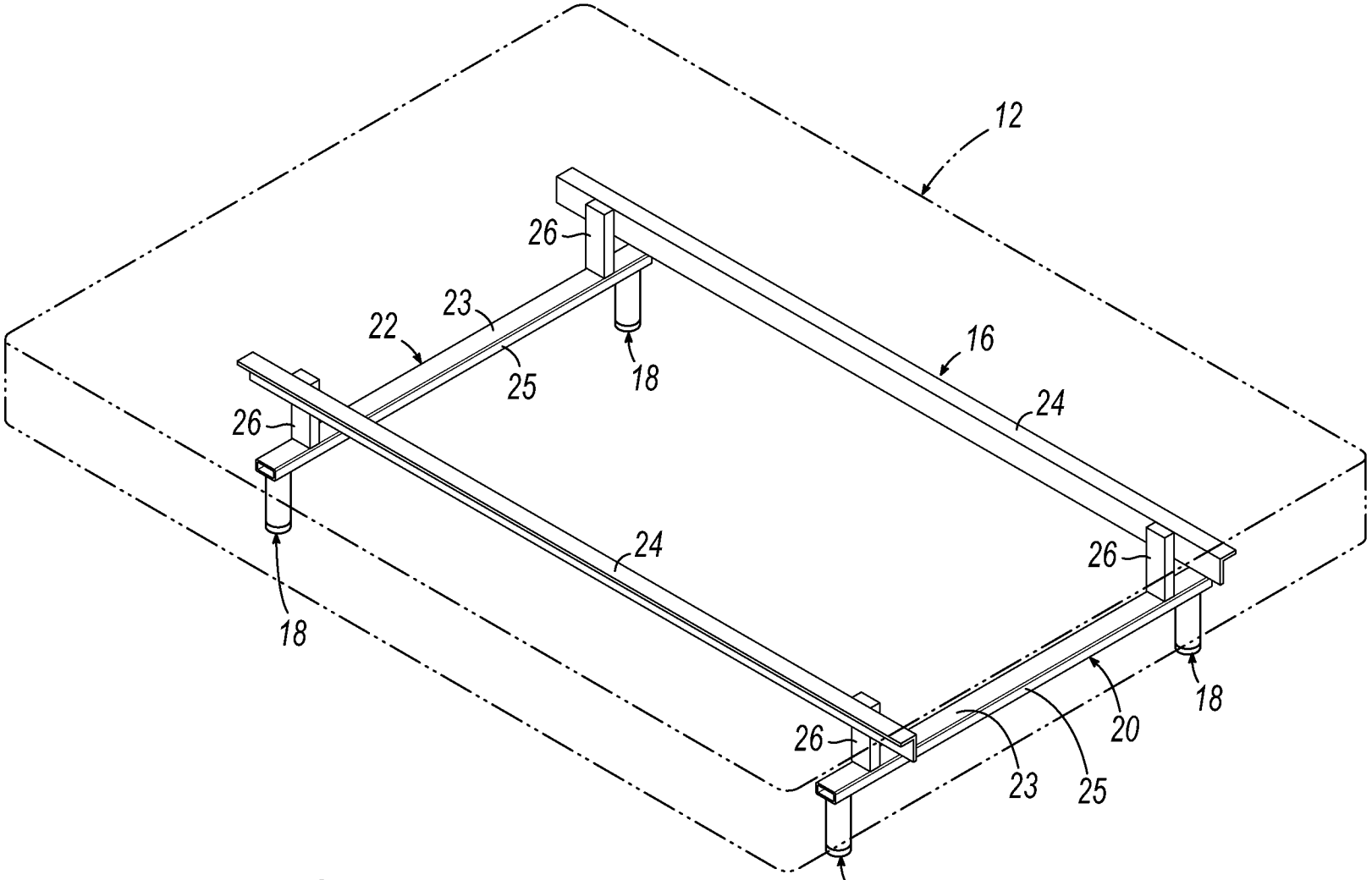
FIG. 2 a perspective view of the bedding foundation of FIG. 1 without the upholstery.

Referring now to FIGS. 1-4, there is illustrated a bedding product 10, including a foundation 12 incorporating the principles of the present invention according to one embodiment. The foundation 12 is configured to support a mattress 14. As shown in FIG. 2, the foundation 12 comprises a generally rectangular frame 16 supported by four foldable leg assemblies 18. Although one type of generally rectangular frame 16 is illustrated as having four foldable leg assemblies 18, any other type of frame 16 may be supported by any number of foldable leg assemblies 18 constructed according to aspects of the invention. The generally rectangular frame 16 is typically made of metal but may be made of any known material. In this regard, the foldable leg assembly 18 may be used in any type of bedding or furniture product and is not intended to be limited by the drawings.

With continued reference to FIG. 2, the generally rectangular frame 16 comprises a head member 20, a foot member 22, two side members 24, and four spacers 26. Each side member 24 extends generally longitudinally from head to foot between the transversely extending head and foot members 20, 22, respectively. As shown, each side member 24 is supported above the head and foot members 20, 22 by two spacers 26. On each side of the generally rectangular frame 16, a first spacer 26 extends between one of the side members 24 and the head member 20, and a second spacer 26 extends between the same side member 24 and the foot member 22. The spacers 26 are configured to couple the side members 24 to the head and foot members 20, 22, as well as space the side members 24 a predetermined distance above the head and foot members 20, 22. It is within the scope of the invention that the spacers 26 be omitted and the side members 24 be directly secured to the head and foot members 20, 22.

Figure 5:
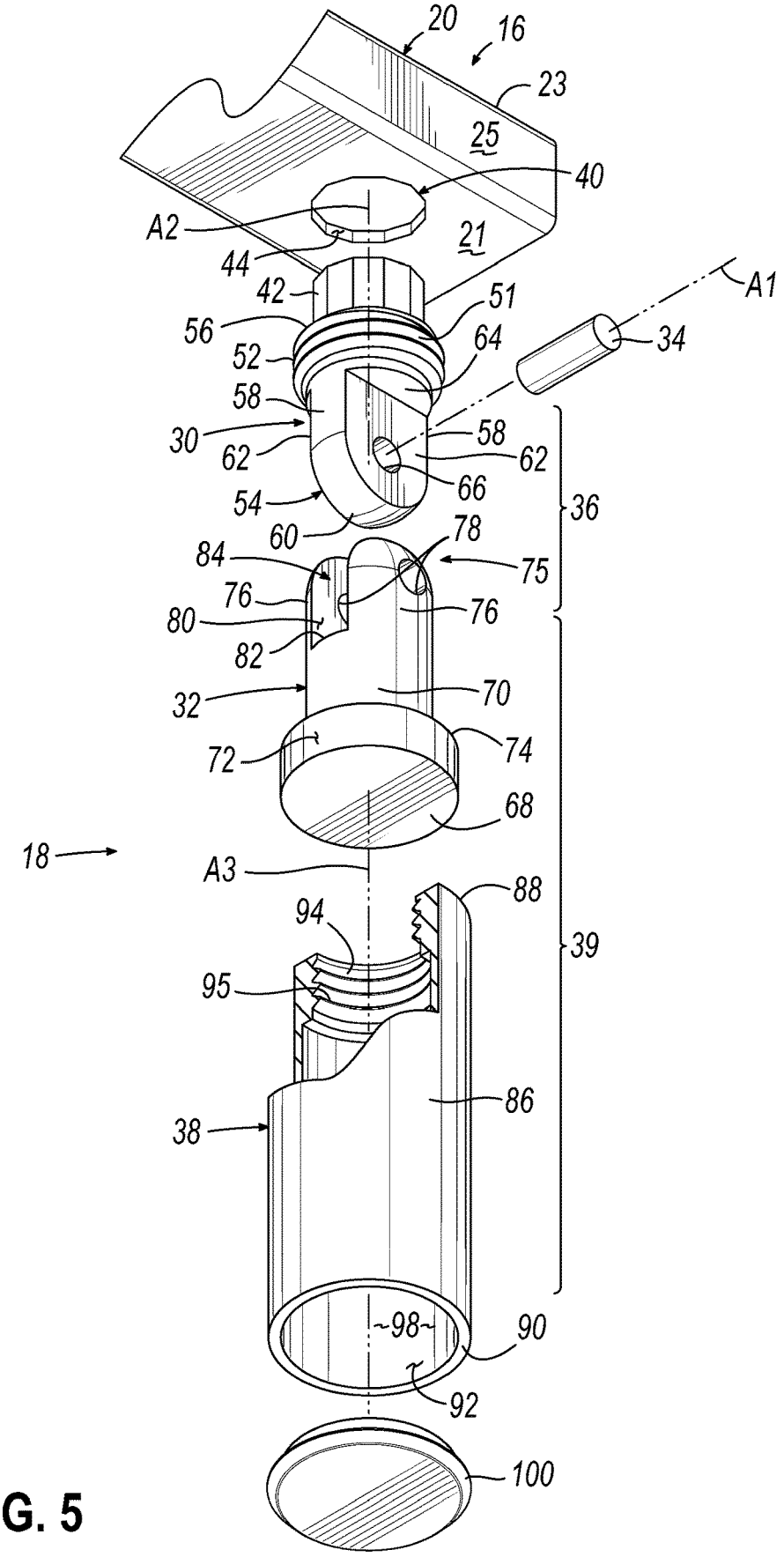
FIG. 5 is an exploded view of the encircled area 5 of FIG. 3.
Figure 6A:
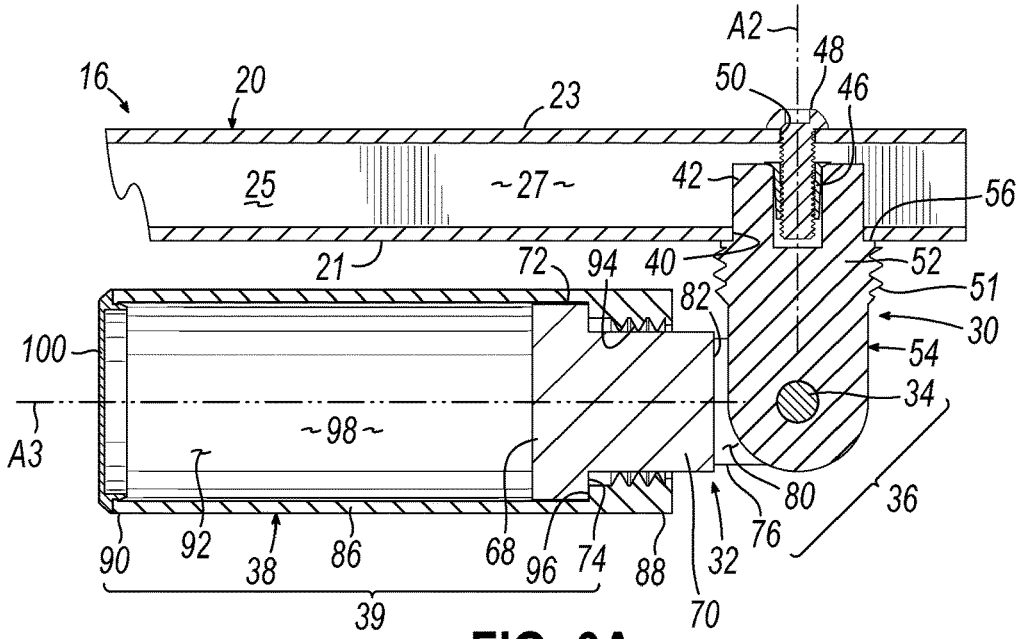
FIG. 6A is a cross-sectional side view showing a foldable leg assembly in a folded position.
Figure 6B:
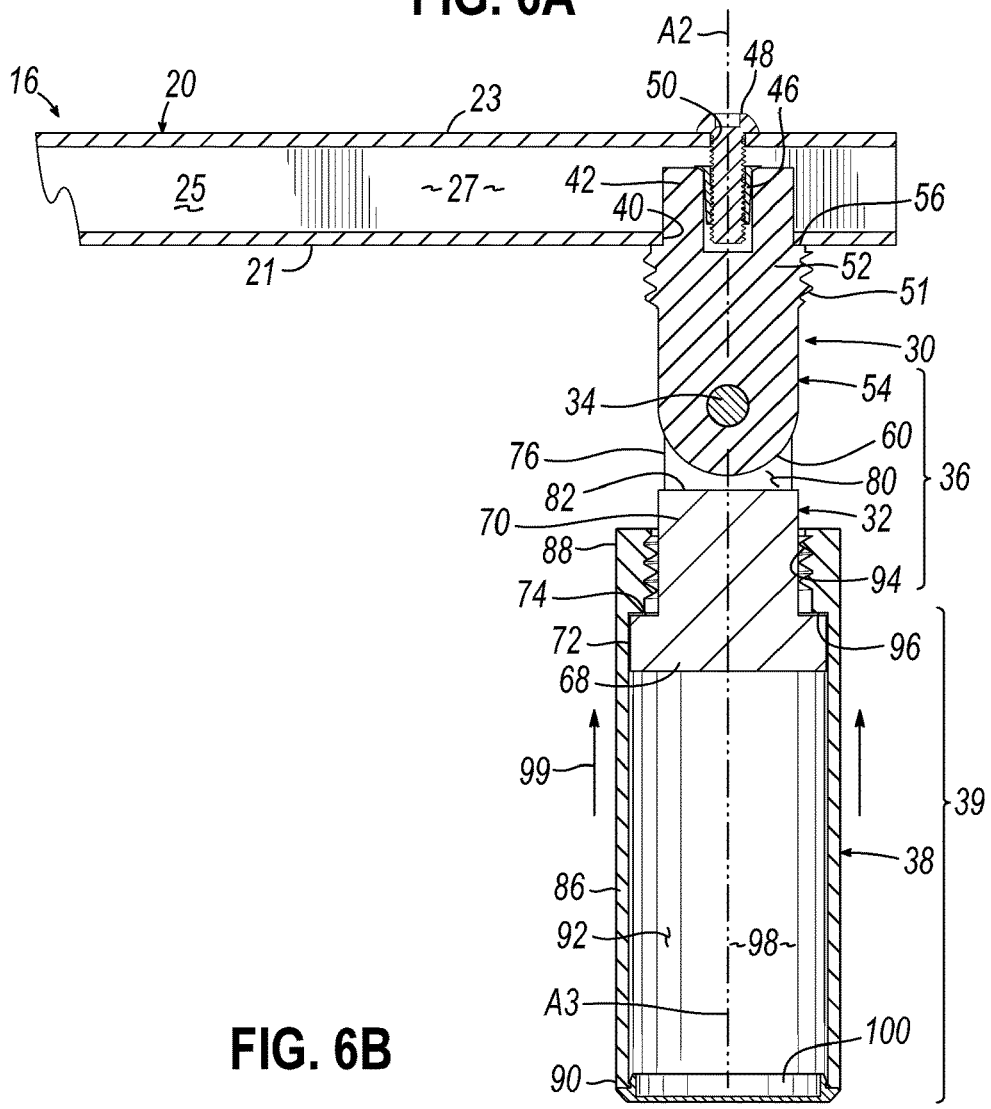
FIG. 6B is a cross-sectional side view showing the foldable leg assembly of FIG. 6A being pivoted to an extended position and the leg member being raised relative to the linkage member.
Figure 6C:
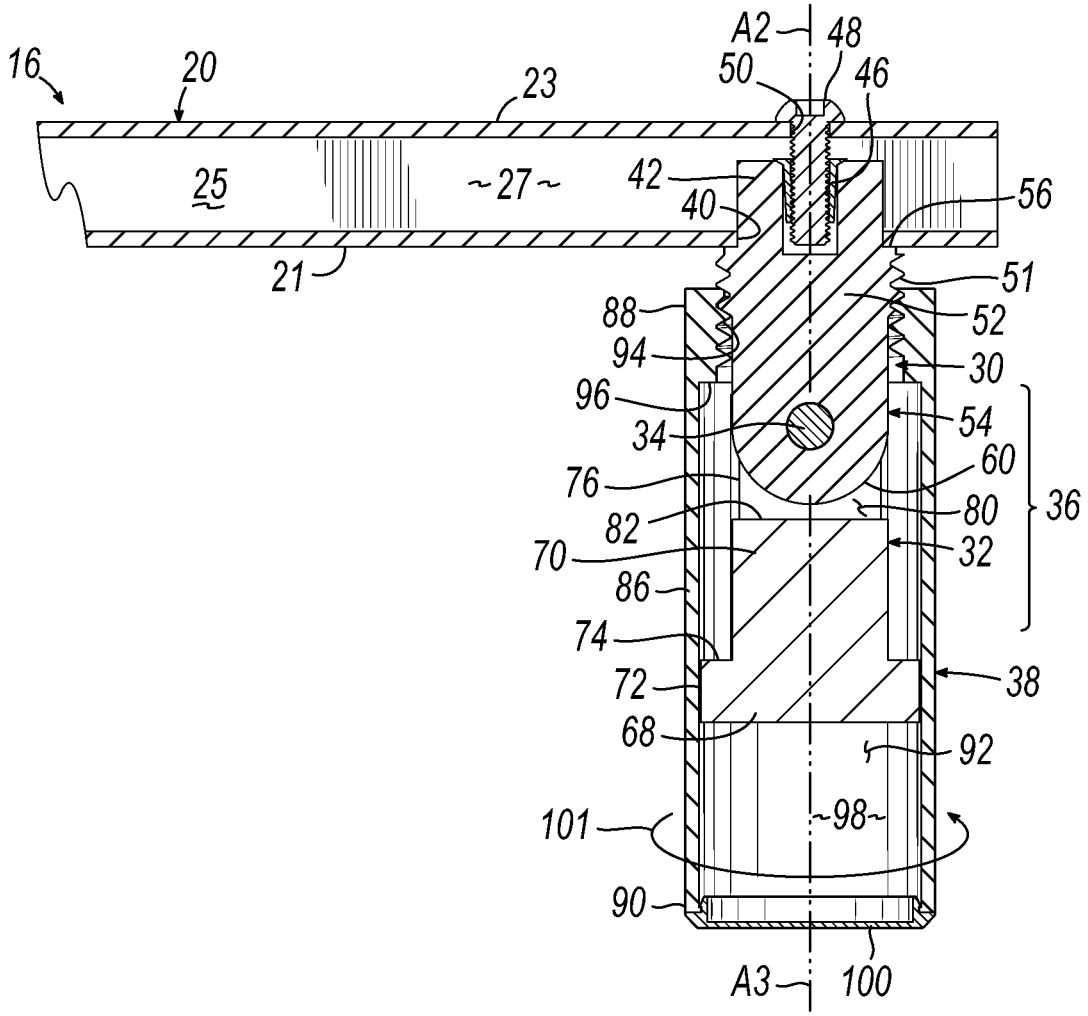
FIG. 6C is a cross-sectional side view showing the foldable leg assembly of FIGS. 6A-6B being further assembled, the leg member being twisted to tighten the leg assembly.
Figure 6D:
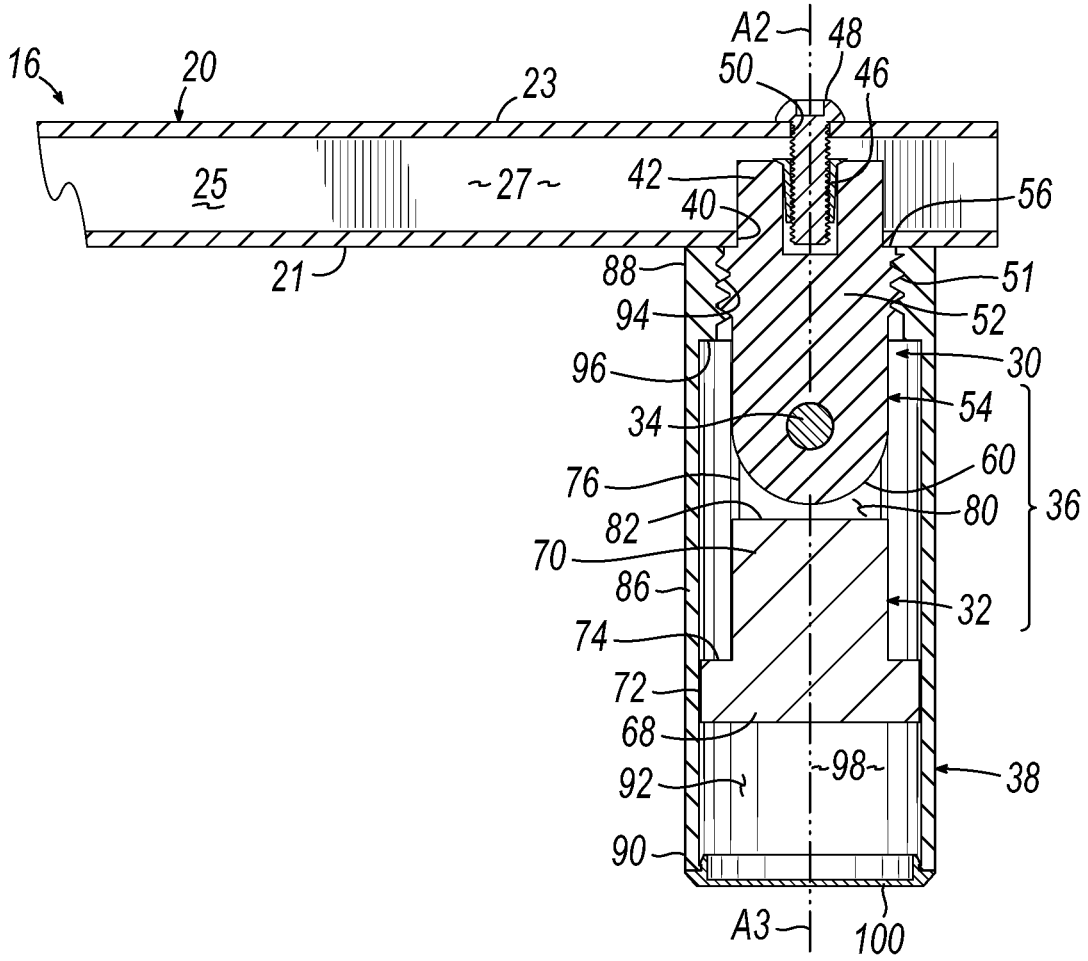
FIG. 6D is a cross-sectional side view showing the foldable leg assembly of FIGS. 6A-6C in a locked position.

As shown in FIGS. 5-6D, the head member 20 of the frame 16 is rectangular in cross-section and comprises a bottom wall 21, a top wall 23 and two side walls 25 which define a hollow interior 27. Although not shown, the foot member 22 of the frame 16 has the same size and configuration. However, it is within the scope of the present invention that the head and foot members 20, 22 of frame 16 may have other configurations and need not be identical.

Figure 3:
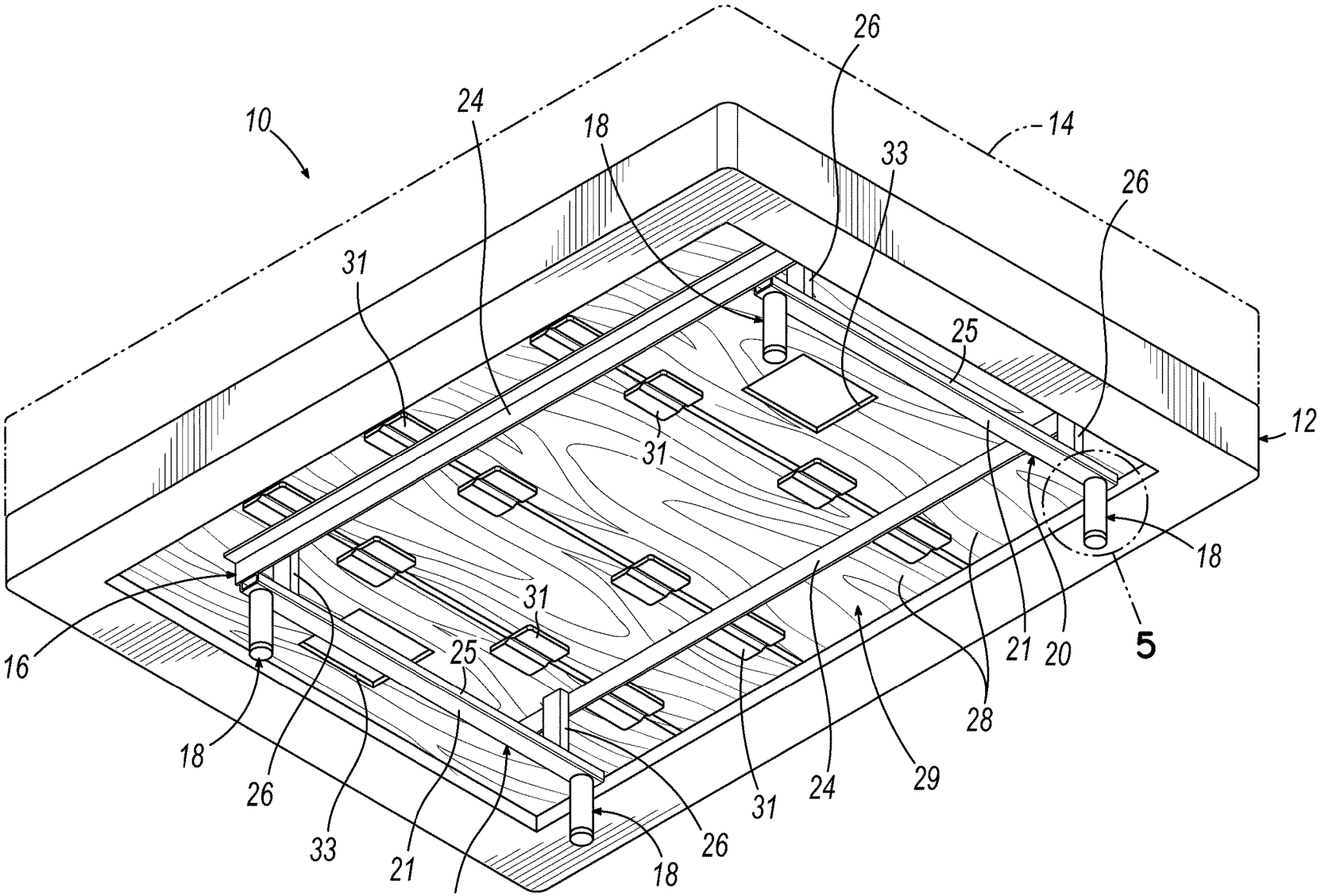
FIG. 3 is a bottom perspective view of the bedding foundation of FIG. 1, showing a frame supported by four foldable leg assemblies shown in a locked position.
Figure 4:
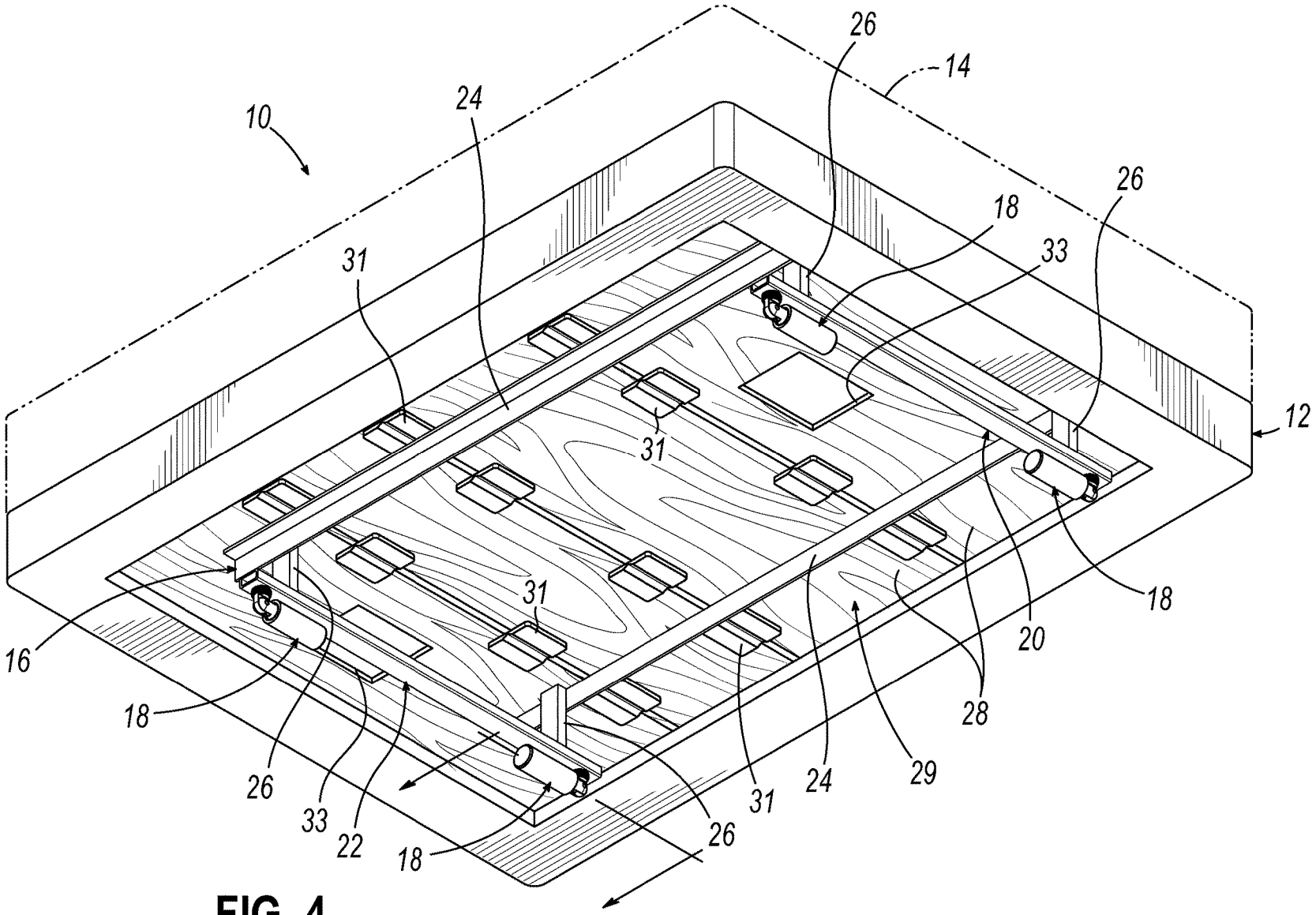
FIG. 4 is a bottom perspective view of the bedding foundation of FIG. 1, showing each of the four foldable leg assemblies in a folded position.

As shown in FIGS. 2-4, the frame 16 further includes four foldable leg assemblies 18. In the embodiment illustrated, two foldable leg assemblies 18 are secured to the head member 20 and two additional foldable leg assemblies 18 are secured to the foot member 22. Each foldable leg assembly 18 is illustrated being secured to the respective head or foot member 20, 22, at a proximal end thereof. However, the quantity and location of the foldable leg assemblies 18 on the frame 16 is not intended to be limited by the drawings. For example, the frame 16 may include more or less than four foldable leg assemblies 18. Furthermore, each foldable leg assembly 18 may be secured to the frame 16 at any location suitable to support the bedding product 10. For example, the foldable leg assemblies 18 may be secured to the side members 24. Although in the embodiment illustrated, the foldable leg assemblies 18 are secured with fasteners to the head and foot members 20, 22 of frame 16 as shown in FIGS. 6A-6D, the foldable leg assemblies 18 may be secured to the frame 16 at any other suitable location on the frame 16 via any suitable method such as welding, or by fasteners, such as screws, bolts, or other like fasteners.

With reference to FIGS. 3-4, the foundation 12 may further comprise a platform 29 supported by the frame 16. The platform 29 comprises a plurality of spaced wooden or plastic slats 28 which may be joined together with hinges 31. Some of the slats 28 of the platform 29 may have openings 33 adapted to receive motors (not shown) for an adjustable bed base. The platform 29 may be configured to engage the side members 24 of the frame 16 such that the foundation 12 is supported by the frame 16. The foldable leg assemblies 18 of the frame 16 may space the platform 29 above a floor for use as shown in FIG. 3. The platform 29 and frame 16 may be part of an adjustable bed base.

The slats 28 of platform 29, or the side members 24 of frame 16, or both, may include one or more connecting members (not shown) configured to receive, for example, screws or other like fasteners, for securing the slats 28 to the frame 16. With specific reference to FIG. 3, a perspective view of the foundation 12 and the frame 16 is shown wherein the foldable leg assembles 18 are in a locked position. As shown, when in the locked position, the foldable leg assemblies 18 are generally perpendicular to the frame 16 and foundation 12 and extend a predetermined distance therefrom. When each foldable leg assembly 18 is assembled in the locked position, as shown in FIG. 3, the frame 16 is fully assembled to support the foundation 12 and mattress 14. As discussed in further detail below each of the foldable leg assemblies 18 are movable between the locked position and a folded position.

Turning now to FIG. 4, a perspective view of the foundation 12 and the frame 16 is shown wherein the foldable leg assembles 18 are in the folded position. In the embodiment shown, the foldable leg assemblies 18 are pivoted to the folded position and closely adjacent to the underside of the frame 16. More specifically, when each foldable leg assembly 18 is in the folded position, most of the foldable leg assembly 18 is folded inwardly and positioned adjacent and substantially parallel to one of the respective head or foot members 20, 22 of frame 16. However, the foldable leg assembly 18 may fold in any other suitable direction and is not intended to be limited by the drawings.

As shown in FIG. 4, when each foldable leg assembly 18 of the frame 16 is in the folded position, the frame 16 is provided with a more compact configuration to facilitate shipping or storing of the bedding product 10 when not in use. In this regard, the frame 16 may be shipped to a consumer in a partially assembled state, with the foldable leg assemblies 18 in the folded position. Compared to the standard practice of packaging and shipping leg assemblies separately, the foldable configuration of the present invention may reduce overall dunnage and shipping costs incurred by parts manufacturers who typically ship such components separately. To this end, the frame 16 may be received by an end user or consumer having the foldable leg assemblies 18 folded, such that the consumer may unfold and lock the leg assemblies 18 without the use of tools, as described in additional detail below.

As best shown in FIG. 5, each foldable leg assembly 18 includes a threaded connector 30, a linkage member 32 pivotally coupled to the threaded connector 30 via a pivot pin 34 to form a pivot joint 36, and a leg member 38 slideably coupled to the linkage member 32 in a coaxial arrangement to define a linkage assembly 39, as will be described in greater detail below. As shown, the pivot pin has longitudinal axis "A1," the threaded connector 30 has longitudinal axis "A2," and the linkage assembly 39 has longitudinal axis "A3." Although FIG. 5 illustrates one foldable leg assembly 18 secured to the head member 20 of frame 16, the foldable leg assembly 18 may be secured to any other member of the frame 16 at any suitable location. Accordingly, the structural features of the leg assembly 18 will each be described in additional detail below.

As best shown in FIG. 5, the head member 20 of frame 16 is provided with a bore 40 through the bottom wall 21 proximal to one end thereof and configured to receive an upper end 42 of the threaded connector 30. In the embodiment shown, the bore 40 defines a polygonal inner surface 44 that corresponds generally to the polygonal shape of the upper end 42 of the threaded connector 30, wherein the bore 40 and the upper end 42 are generally cylindrical in shape. In this regard, the bore 40 is configured to tightly receive the upper end 42 of the threaded connector 30 such that the polygonal inner surface 44 of the bore 40 engages the polygonal upper end 42 of the threaded connector 30, preventing rotation therebetween. Alternatively, the bore 40 and the upper end 42 of the threaded connector 30 may have different configurations, for example, both may be cylindrical, oval, or any other suitable shape. The threaded connector 30 may be fixed to the head member 20 of frame 16 via any suitable method such as welding, or by fasteners, such as screws, bolts, or other like fasteners, as described in further detail below. The threaded connector 30 does not move regardless of the position of the leg assembly 18 and regardless of how the threaded connector 30 is fixed to the frame 16.

As best shown in FIGS. 6A-6D, the threaded connector 30 preferably is a unitary member but may be made of multiple members. The upper end 42 of the threaded connector 30 has a threaded recess 46 configured to receive a fastener 48 for coupling the threaded connector 30 to the head member 20 of the frame 16. As shown in FIGS. 6A-6D, when the upper end 42 of the threaded connector 30 is positioned within the bore 40 in the head member 20 of frame 16, the fastener 48 may be disposed through a diametrically opposed bore 50 extending through the top wall 23 in the head member 20 of frame 16, wherein the fastener 48 is configured to threadably engage the recess 46 in the upper end 42 of the threaded connector 30. In this regard, the threaded engagement between the fastener 48 and the recess 46 fixedly couples the threaded connector 30 to the head member 20 of the frame 16. Furthermore, the threaded connector 30 is stationary relative to the member 20, 22, of the frame 16 regardless of the position of the other components of the leg assembly 18. However, it will be appreciated that other suitable means may be used to couple the threaded connector 30 to either the head or foot member of the frame 16 so the threaded connector 30 is stationary regardless of the position of the leg assembly 18.

As shown in FIG. 5, the threaded connector 30 further includes a generally cylindrical body 52 provided with external threads 51, the generally cylindrical body 52 being below the upper end 42 of the threaded connector 30. The upper end 42 projects axially from the body 52, along axis "A2," and a boss 54 projects from the body 52 along axis "A2" and in an opposite direction from the upper end 42. As shown in FIG. 5, the diameter of the upper end 42 of the threaded connector 30 is smaller than the diameter of the threaded body 52 of the threaded connector 30. In this regard, the upper end 42 of the threaded connector 30 is positioned radially inwardly relative to the threaded body 52 of the threaded connector 30 to define an annular shoulder 56 therebetween. As best shown in FIGS. 6A-6D, the annular shoulder 56 is configured to abut the bottom wall 21 of the head or foot member 20, 22 of the frame 16 when the threaded connector 30 is attached thereto, positioning the threaded body 52 substantially adjacent to the head or foot member 20, 22 of the frame 16. When so positioned, the threaded body 52 and boss 54 of the threaded connector 30 remain exposed below the respective head or foot member 20, 22, of the frame 16, such that the linkage member 32 may be operatively coupled to the boss 54 to facilitate pivotal movement of the foldable leg assembly 18 between the folded and locked positions, as discussed in further detail below.

As best shown in FIG. 5, the boss 54 of the threaded connector 30 projects axially along longitudinal axis "A2" from the threaded body 52 of the threaded connector 30 and has a width that generally corresponds to the width of the threaded body 52. In this regard, the boss 54 has two rounded surfaces 58 that are smooth, continuous extensions of the threaded body 52, extending axially along longitudinal axis "A2" to a hemispheric end 60 of the boss 54. The boss 54 further includes opposed flatted sides 62, adjacent to the rounded sides 58 and positioned radially inwardly relative to the threaded body 52 to define two semicircular-shaped shoulders 64. As shown, the flatted sides 62 of the boss 54 extend axially along longitudinal axis "A2" from the threaded body 52 and through the hemispheric end 60 so as to truncate the hemispherical shape of the end 60 of the boss 54. The flatted sides 62 of the boss 54 further include a horizontal through-bore 66 disposed adjacent to the hemispheric end 60 and configured to tightly receive the pivot pin 34 therethrough. As shown in FIG. 5, the pivot pin 34 has a longitudinal axis "A1" which is the pivot axis of the leg assembly 18.

With continued reference to FIG. 5, the linkage member 32 comprises a unitary member having a generally cylindrical base 68 and a cylindrical body 70 extending from the generally cylindrical base 68 to a hemispherically shaped split connector 75. The hemispherically shaped split connector 75 is configured to pivotally receive the boss 54 of the threaded body 52 of the threaded connector 30. As shown in FIG. 5, the cylindrical body 70 of the linkage member 32 is spaced radially inwardly relative to an outer surface 72 of the base 68 to define an annular flange 74. As discussed in additional detail below, the annular flange 74 facilitates the coaxial coupling of the leg member 38 to the linkage member 32, such that the leg assembly may slideably receive the linkage member therein. The split connector 75 includes a pair of spaced apart and substantially parallel arms 76 provided with axially aligned through-bores 78 for closely receiving portions of the pivot pin 34 therethrough.

As shown in FIG. 5, each arm 76 of split connector 75 of the linkage member 32 further includes a flatted inner surface 80 extending from a bearing surface 82 to define a generally rectangular notch 84 configured to closely receive the boss 54 of the threaded connector 30 therein. In this regard, when the boss 54 of the threaded connector 30 is fully received within the notch 84 of the linkage member 32, the bore 66 in the boss 54 and the bores 78 in the arms 76 of the split connector 75 are configured to substantially align so that the pivot pin 34 may be disposed therethrough, pivotally coupling the linkage member 32 to the threaded connector 30 to form pivot joint 36 having pivot axis "A1." In this regard, the length of the pivot pin 34 is sized such that when the pivot pin 34 is disposed through the bores 66, 78, the ends of the pivot pin 34 are substantially co-planar with the body 70 of the linkage member 32 so as not to inhibit movement of the leg member 38, as described in further detail below. In one embodiment, the engagement between the linkage member 32, threaded connector 30, and pivot pin 34, forming the pivot joint 36, may be a frictional engagement such that the leg assembly 18 is not capable of freely pivoting on its own. In this regard, the amount of force required to maneuver or pivot the leg assembly 18 is configured to be within the capacity of an adult person using his or her hands.

As best shown in FIGS. 5-6D, when the linkage member 32 and threaded connector 30 are pivotally coupled via pivot pin 34, the hemispheric end 60 of the boss 54 is adjacent to the bearing surface 82 of the notch 84 and, similarly, the arms 76 of the linkage member 32 are adjacent to the semicircular-shaped shoulders 64 of the threaded connector 30. In this regard, the rounded shape of both the hemispheric end 60 of the boss 54 and the ends of the arms 76 of the split connector 75 facilitate clearance for pivotal movement of the linkage member 32 and, more specifically, pivotal movement of the linkage assembly 39 about pivot axis "A1." By way of example and without limitation, in one embodiment, the linkage assembly 39 may pivot about the pivot axis "A1" between about 70 and 270 degrees. In a preferred embodiment, the linkage assembly 39 may pivot between about 170 and 190 degrees about the pivot axis "A1" and, even more preferably, about 180 degrees.

With continued reference to FIGS. 5-6D, the leg member 38 includes a generally cylindrical wall 86 extending between upper and lower ends 88, 90, and including a first inner surface 92 adjacent to the lower end 90, and a second, inner surface 94 provided with threads 95 and adjacent to the upper end 88. The first and second inner surfaces 92, 94, are separated by a shoulder 96 as best seen in FIG. 6B. As shown in FIGS. 6C and 6D, the first and second inner surfaces 92, 94, of leg member 38 define a generally cylindrical cavity 98 configured to telescopically receive at least a portion of the threaded connector 30, a portion of the linkage member 32, and the pivot joint 36 therein. As seen in FIG. 5, each leg member 38 may also include an end cap 100 surrounding a portion of the lower end 90 of the leg member 38 and configured to be secured thereto. As shown, the leg member 38 has a generally circular cross-sectional shape and the leg member 38 is of suitable length to receive the components of the foldable leg assembly 18 therein, as discussed in further detail below. However, the leg member 38 shown and described herein may be varied in size and shape, as known in the art, without departing from the scope of the present invention.

As best shown in FIGS. 6A-6D, the leg member 38 is coaxially coupled to the linkage member 32 to define the linkage assembly 39. In this regard, when coaxially coupled to the linkage member 32, the leg member 38 is configured to be rotatable about the linkage member 32, and slideable relative to the linkage member 32 such that the linkage member 32 may slide within the cavity 98 of the leg member 38 so as to be partially or wholly disposed within the cavity 98 of the leg member 38. In this regard, the leg member 38 can be slid in an upward or downward direction along axis "A3" relative to the linkage member 32. As discussed in further detail below, the downward movement of the leg member 38 is restricted by the engagement between the shoulder 96 of the leg member 38 and the annular flange 74 of the linkage member 32.

As shown in FIG. 6A, when the linkage member 32 is in the folded position, the upper end 88 of the leg member 38 is positioned farthest away, along axis "A3," from the pivot joint 36 such that a portion of the linkage member 32 is partially extended from the leg member 38. In this regard, the shoulder 96 of the leg member 38 confronts or abuts the annular flange 74 of the linkage member 32. The leg member 38 remains in this position between the collapsed position shown in FIG. 6A, and the extended position shown in FIG. 6B. In this regard, the linkage member 32 is constrained from moving axially along longitudinal axis "A3" within the cavity 98 of the leg member 38 beyond a specified limit by the eventual interference of the annular flange 74 of the linkage member 32 impinging against the shoulder 96 of the leg member 38. Thereby coaxially coupling the leg member 38 and the linkage member 32 such that the leg member 38 is movable relative to the linkage member 32, yet the leg member 38 and linkage member 32 are non-separable.

With continued reference to FIGS. 6A-6D, the diameter of the base 68 of the linkage member 32 is slightly smaller in size compared to the diameter of the first inner surface 92 of the leg member 38, which is configured to closely receive the base 68 of the linkage member 32. As shown in FIGS. 6A-6D, the outer surface 72 of the base 68 of the linkage member 32 may slideably engage the first inner surface 92 of the leg member 38. Similarly, the diameters of the body 70 of the linkage member 32 and the boss 54 of the threaded connector 30 are slightly smaller in size compared to the second, threaded inner surface 94 of the leg member 38, which is configured to slide in an axial direction along longitudinal axis "A3" over these elements 30, 32. To this end, the leg member 38 may slide axially along longitudinal axis "A3" such that the linkage member 32, pivot joint 36, and a portion of the threaded connector 30 are telescopically received within the cavity 98 of the leg member 38. As shown, the second inner surface 94 of the leg member 38 is configured to threadably receive the body 52 of the threaded connector 30, thereby coupling the leg member 38 to the threaded connector 30 and the frame 16, as described in further detail below.

With continued reference to FIGS. 6A-6D, operation of the leg assembly 18 between the folded position and the locked position will now be described in greater detail for the present embodiment. In this regard, FIG. 6A shows the head member 20 of frame 16 having a foldable leg assembly 18 fixed thereto and in the folded position, illustrating a typical arrangement for shipping a frame 16 to an end user, for example. As shown in FIG. 6A, the linkage assembly 39 is substantially parallel to the head member 20 and longitudinal axis "A3" of the linkage assembly 39 is substantially perpendicular to longitudinal axis "A2" of the stationary threaded connector 30. When the leg assembly 18 is in the folded position, a portion of the linkage member 32, a portion of the threaded connector 30, and the pivot joint 36 are exposed outside the cavity 98 of the leg member 38. When so positioned, the shoulder 96 of the leg member 38 is adjacent to or abuts the annular flange 74 of the linkage member 32, as set forth above. In this regard, when the pivot joint 36 is exposed outside the leg member 38, as shown in FIG. 6A, the linkage assembly 39 may be pivoted about pivot axis "A1," and the leg assembly 18 may be moved to the folded position. To move the foldable leg assembly 18 from the folded position to the extended position shown in FIG. 6B, the linkage assembly 39 is pivoted about 90 degrees relative to the pivot axis "A1," to the extended position wherein the longitudinal axis "A3" of the linkage assembly 39 is substantially aligned with the longitudinal axis "A2" of the threaded connector 30 and substantially perpendicular to the head member 20 of the frame 16, as best shown in FIG. 6B. However, the linkage assembly 39 may be configured to pivot more or less degrees about the pivot axis "A1."

With continued reference to FIG. 6B, when linkage assembly 39 is in the extended position, the leg member 38 is positioned such that the shoulder 96 of the leg member 38 abuts the annular flange 74 of the linkage member 32 so as to position the upper end 88 of the leg member 38 farthest away from the head member 20 of the frame 16. From the extended position, the leg member 38 may be slid in an upward direction, as indicated by arrows 99 in FIG. 6B, towards the head member 20 of the frame 16. In this regard, as the leg member 38 is slid upwardly, the leg member 38 traverses the body 70 of the linkage member 32, pivot joint 36, and the boss 54 of the threaded connector 30, thereby telescopically receiving these elements 30, 32, 36 within the cavity 98 of the leg member 38. The leg member 38 is slid upwardly until the upper end 88 of the leg member 38 nears the body 52 of the threaded connector 30, as shown in FIG. 6C.

As shown in FIG. 6C, when the upper end 88 of the leg member 38 nears the body 52 of the threaded connector 30, the body 52 is partially received within cavity 98 of the leg member 38, whereby rotation of the leg member 38, as indicated by arrow 101, causes the threads 95 on the second inner surface 94 of the leg member 38 to engage the external threads 51 of the body 52 of the threaded connector 30. Through continued rotation, the leg member 38 further traverses the body 52 of the threaded connector 30, moving upward, further receiving the threaded connector 30 within the cavity 98 of the leg member 38, until the upper end 88 of the leg member 38 abuts the bottom wall 21 of the head member 20 of the frame 16, as shown in FIG. 6D. Although in the embodiment illustrated the leg member 38 is rotated in a clockwise direction to threadably join the leg member 38 to the threaded connector 30, the leg member 38 may alternatively be configured to rotate in a counterclockwise direction to threadably engage and be threadably joined to the threaded connector 30.

As shown in FIG. 6D, when the upper end 88 of the leg member 38 abuts the bottom wall 21 of the head member 20 of the frame 16, the leg member 38 is threadably joined to the threaded connector 30 and head member 20 of the frame 16, forming a rigid connection therebetween. In this regard, the foldable leg assembly 18 is in the locked, assembled position, to provide maximum stability and support for the bedding product 10. As shown, when the leg member 38 is in the locked position, the linkage member 32, pivot joint 36, and a portion of the threaded connector 30 are disposed within the cavity 98 of the leg member 38. Furthermore, both the threaded engagement between the leg member 38 and the threaded connector 30, as well as the confronting relationship between the leg member 38 and the head member 20 of the frame 16, prevents the leg assembly 18 from moving relative to the frame 16 when in the locked position.

To decouple the leg member 38 and position the foldable leg assembly 18 in the folded position from the locked position, the leg member 38 is rotated in the opposite direction until the threaded connection is broken. At this time, the leg member 38 can be slid downward and away from the frame 16 until the shoulder 96 of the leg member 38 abuts the annular flange 74 of the linkage member 32. When so positioned, a portion of the threaded connector 30, a portion of the linkage member 32, and the pivot joint 36 are exposed from the cavity 98 of the leg member 38 thereby allowing the linkage assembly 39 to pivot to the folded position. To prevent the linkage assembly 39 from over-pivoting and contacting the frame 16, in one embodiment, the arms 76 of the linkage member 32 may be configured to abut the semicircular-shaped shoulders 64 of the threaded connector 30.

Referring now to FIGS. 7-10, in which like reference numerals refer to like features in FIGS. 1-6D, a furniture product in the form of a table 102 in accordance with an alternative embodiment is shown. In the embodiment shown, each foldable leg assembly 18*a* may be similar to the foldable leg assembly 18 of FIGS. 1-6D in many respects, but differ in the configuration of the leg member. As shown, the table 102 includes a table top 104 and a supporting frame 106 extending around the periphery of the table top 104, the frame 106 further comprising four foldable leg assemblies 18*a* secured thereto and configured to support the table 102. The foldable leg assembly 18*a* being movable between a locked position, shown in FIG. 8, and a folded position, shown in FIG. 9. In this regard, and like the embodiment shown in FIGS. 1-6D, a portion of the linkage member 32, a portion of the threaded connector 30, and the pivot joint 36 may be slideably exposed outside from the cavity 98 of the leg member 38*a* to pivot the leg assembly 18*a* to the locked position. Likewise, a portion of the linkage member 32, a portion of the threaded connector 30, and the pivot joint 36 may be telescopically received within the cavity 98 of the leg member 38*a*, thereby allowing the leg member 38*a* to be threadably coupled to the threaded connector 30 to position the leg assembly 18*a* in the locked position. In this regard, operation of the leg assembly 18*a* between the folded position and the locked position for the present embodiment is conducted in the same way as set forth above for the embodiment shown in FIGS. 1-6D.

Figure 7:
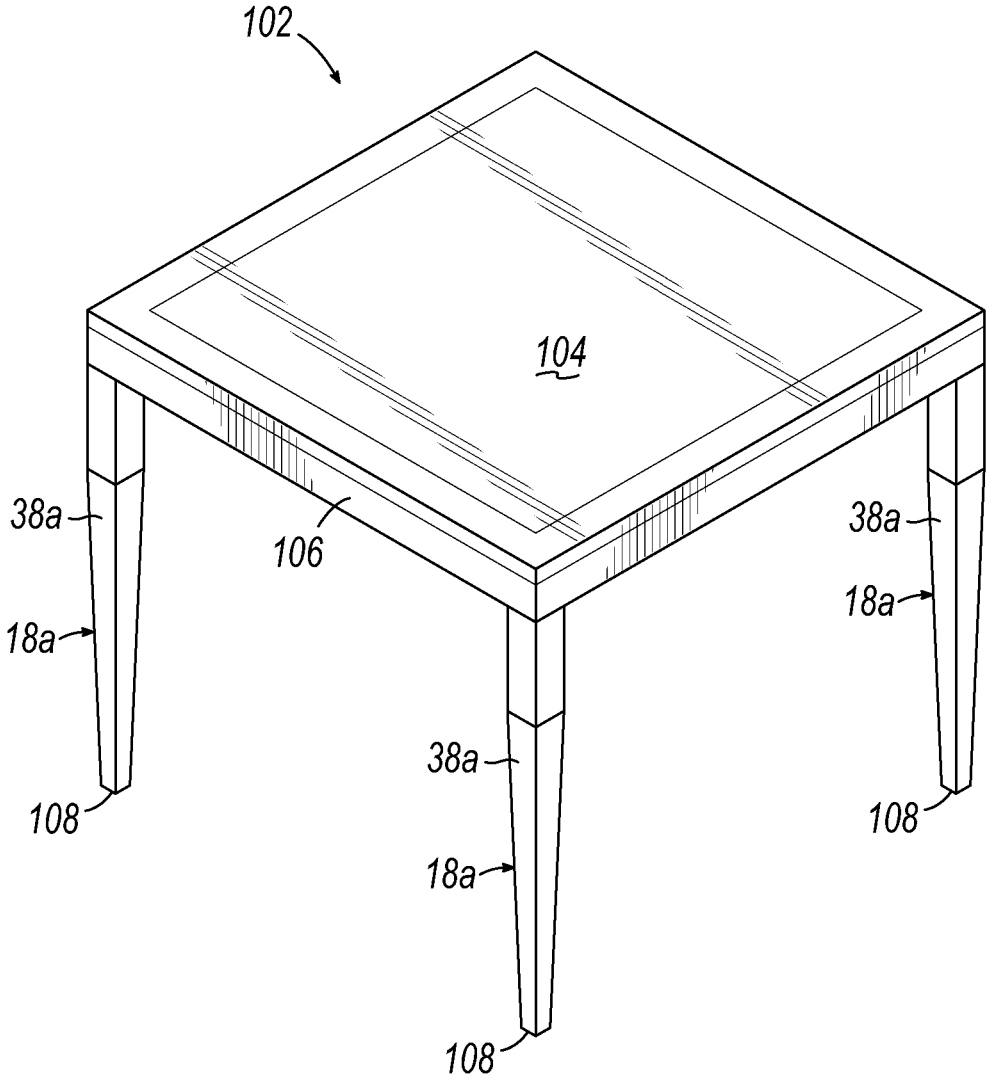
FIG. 7 is a perspective view of a furniture product having foldable leg assemblies according to an alternative embodiment of the invention.
Figure 8:
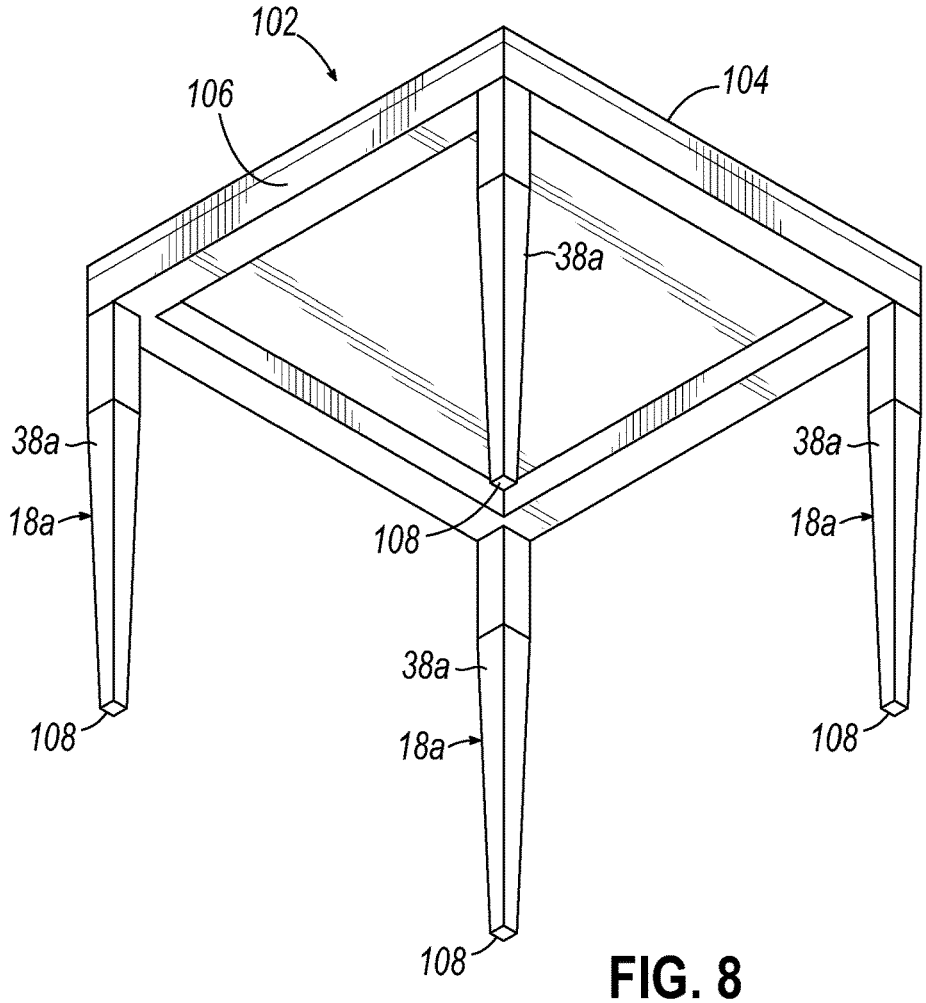
FIG. 8 is a bottom perspective view of the furniture product of FIG. 7, showing the foldable leg assemblies in a locked position.
Figure 9:
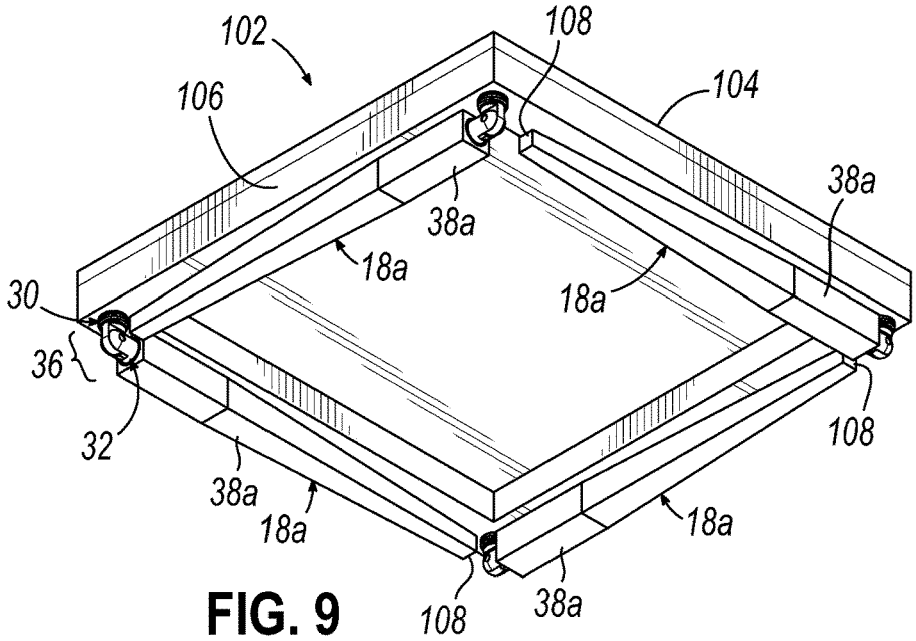
FIG. 9 is a bottom perspective view of the furniture product of FIG. 7, showing the foldable leg assemblies in a folded position.
Figure 10:
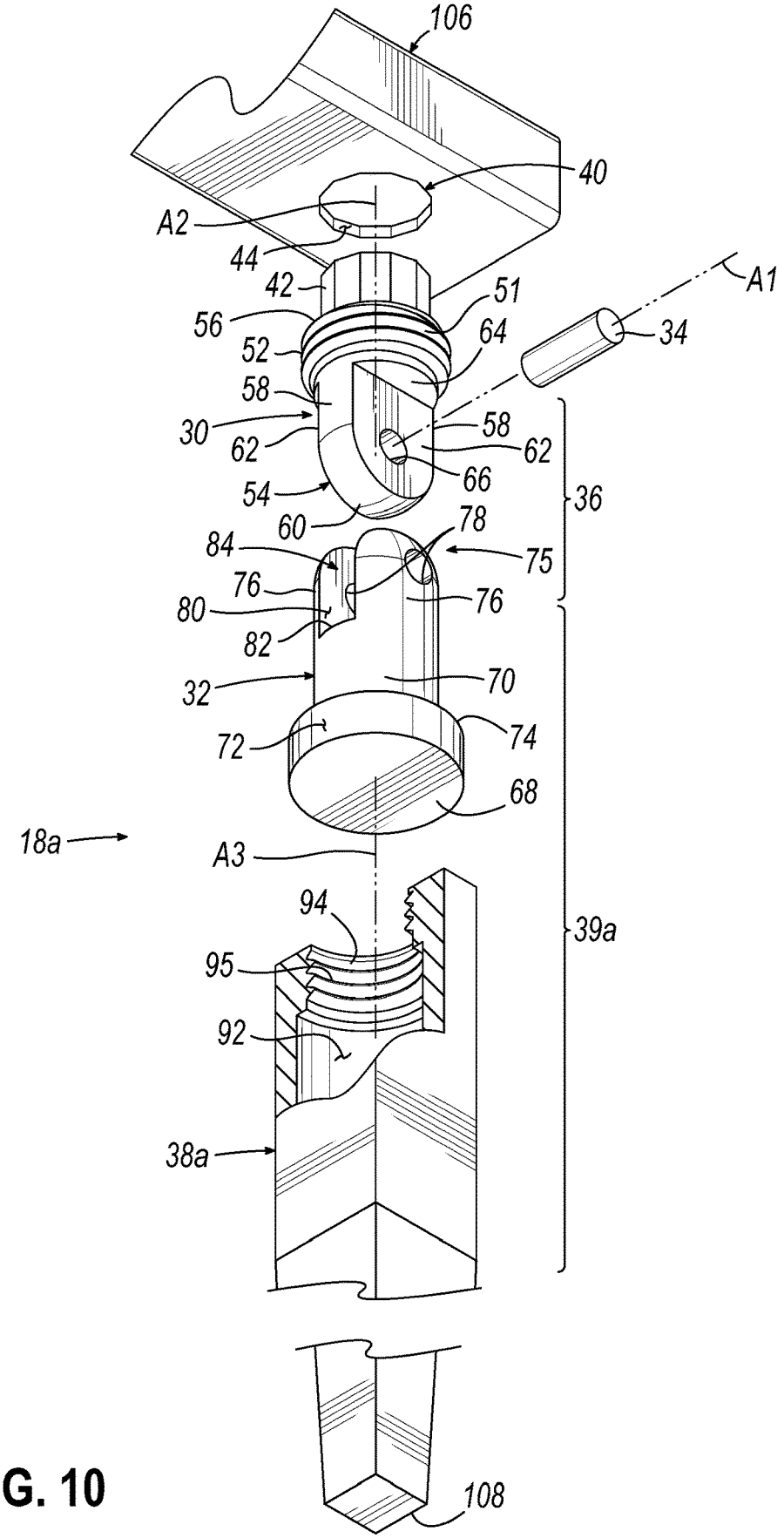
FIG. 10 is an exploded view of one of the foldable leg assemblies of the product shown in FIGS. 7-9.

As best shown in FIG. 10, each foldable leg assembly 18*a* includes a threaded connector 30, a linkage member 32 pivotally coupled to the threaded connector 30 via a pivot pin 34 to form a pivot joint 36, and a leg member 38*a* slideably coupled to the linkage member 32 in a coaxial arrangement to define a linkage assembly 39*a*. Each leg assembly 18*a* may be secured to a corner point around the periphery of frame 106 the table 102 as shown in FIGS. 7-9. However, the foldable leg assemblies 18*a* may be secured at any other suitable location on the frame 106 of the table 102. As shown, each foldable leg assembly 18*a* includes a leg member 38*a* that is substantially longer compared to the leg member shown in other embodiments. In this regard, each leg member 38*a* has a generally square cross-sectional shape, tapering down to a truncated foot 108. Although the cross-sectional shape of the leg member 38*a* may be square, or any other suitable geometry, for example, the cavity 98 of the leg member 38*a*, defined by the first and second inner surfaces 92, 94, remains generally cylindrical in shape, as seen in FIG. 10. To this end, the operation of the leg assembly 18*a* from the folded position, to the extended position, and to the locked position is the same as discussed above for the embodiment shown in FIGS. 6A-6D.

The elements that form the frames 16, 106, and more specifically, the foldable leg assemblies 18, 18*a*, may be formed from a variety of materials. For example, the leg member 38, 38*a*, threaded connector 30, and linkage member 32 may be formed from suitable engineering plastics or metal (e.g., steel, aluminum, carbon steel, or any plated metal) and have other suitable cross-sectional shapes. However, these materials are exemplary and it should be recognized that other materials may be used, such as wood, for example. In contrast, the end cap 100 may be molded from suitable engineering plastics, including, for example, polypropylene, polyethylene or other suitable plastics. However, the invention is not so limited as to the elements that form the foldable leg assembly 18, 18*a*, which may be formed from other suitable materials.

One advantage of the present invention is that a customer may receive the product 10, 102, in a box via the mail or a common carrier and assemble the product 10, 102 quickly and easily without the use of tools. The products 10, 102, are shipped to a consumer with the components, such as the foldable leg assemblies 18, 18*a*, already attached to the frame 16, 106, for example. To fully assemble the product, a consumer must only pivot each foldable leg assembly 18, 18*a*, from the folded position to the extended position, slide the leg member 38, 38*a* towards the threaded connector 30 and thread the leg member 38, 38*a* thereto for the locked position, as described above.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of those features. Accordingly, the scope of the invention shall be limited only by the following claims and their equivalents.

What is claimed is:

1. A leg assembly for use in a bedding or furniture product, the leg assembly comprising:

a threaded connector adapted to be securable to a member of a frame of the product;

a linkage member pivotally coupled to the threaded connector to form a pivot joint therebetween, the pivot joint having a pivot axis; and a leg member coaxially coupled to the linkage member to define a linkage assembly, the leg member being rotatable and slideable relative to the linkage member and having a threaded inner surface adjacent to an upper end configured to threadably couple to the threaded connector;

wherein the leg assembly is movable between a locked position and a folded position, the threaded connector configured to be stationary relative to the member of the frame regardless of any one of the locked position and the folded position of the leg assembly.

2. The leg assembly of claim 1, wherein when the leg assembly is in the locked position, the leg member is threadably coupled to the threaded connector such that the upper end of the leg member is configured to abut the member of the frame, the linkage member, pivot joint, and a portion of the threaded connector being disposed within a cavity of the leg member.

3. The leg assembly of claim 1, wherein when the leg assembly is in the folded position, a portion of the linkage member is disposed within a cavity of the leg member and the linkage assembly is pivotal about the pivot axis of the pivot joint to a position substantially parallel to the member of the frame.

4. The leg assembly of claim 1, wherein the threaded connector is secured to the member of the frame with at least one fastener.

5. The leg assembly of claim 1, wherein the leg member further includes a cavity configured to telescopically receive the linkage member, pivot joint, and a portion of the threaded connector therein.

6. The leg assembly of claim 1, wherein the linkage assembly pivots at least 90 degrees about the pivot axis of the pivot joint.

7. The leg assembly of claim 1, wherein when the leg member further includes a lower end having an inner surface adjacent to the lower end, the threaded inner surface adjacent to the upper end and the inner surface adjacent to the lower end being separated by a shoulder, the shoulder configured to abut the linkage member.

8. The leg assembly of claim 1, wherein the threaded connector includes a boss extending from the threaded connector in an axial direction and the linkage member includes a split connector configured to receive the boss and be pivotally coupled thereto.

9. The leg assembly of claim 1, wherein the linkage member and threaded connector are pivotally coupled together with a pivot pin.

10. The leg assembly of claim 1, wherein the threaded connector further comprises an upper end configured to be received through a bore in the member of the frame, the upper end of the threaded connector having a recess configured to receive a fastener for fixing the threaded connector to the member of the frame.

11. The leg assembly of claim 10, wherein the recess is threaded and configured to receive a threaded fastener.

12. A leg assembly for use in a bedding or furniture product, the leg assembly comprising:

a threaded connector having a cylindrical body provided with threads with an upper end extending in an axial direction therefrom and a boss extending in the axial direction away from the cylindrical body and diametrically opposed from the upper end, the threaded connector adapted to be securable to a member of a frame of a product;

a linkage member having a cylindrical base with a body extending in the axial direction therefrom to a split connector, the split connector having two arms defining a notch configured to receive the boss of the threaded connector therein such that the boss and split connector are pivotally coupled together with a pivot pin to form a pivot joint having a pivot axis; and a leg member coaxially coupled to the linkage member to define a linkage assembly, the leg member being rotatable and slideable relative to the linkage member and having a threaded inner surface adjacent to an upper end configured to threadably couple to the threaded connector;

wherein the leg assembly is movable between a locked position and a folded position.

13. The leg assembly of claim 12, wherein when the leg assembly is in the locked position, the leg member is threadably coupled to the threaded connector such that the upper end of the leg member is configured to abut the frame, the linkage member, pivot joint, and a portion of the threaded connector being disposed within a cavity of the leg member.

14. The leg assembly of claim 12, wherein when the leg assembly is in the folded position, a portion of the linkage member is disposed within a cavity of the leg member and the linkage assembly is pivotal about the pivot axis of the pivot joint to a position substantially parallel to the member of the frame.

15. The leg assembly of claim 12, the leg member further including a lower end having an inner surface adjacent to the lower end, wherein the threaded inner surface adjacent to the upper end and the inner surface adjacent to the lower end are separated by a shoulder, the shoulder configured to be in a confronting relationship with the linkage member.

16. The leg assembly of claim 15, wherein the linkage member further includes an annular flange configured to abut the shoulder of the leg member.

17. The leg assembly of claim 12, wherein the linkage assembly pivots at least 90 degrees about the pivot axis of the pivot joint.

18. A method of assembling a furniture or bedding product having a leg assembly secured to a member of a frame, the method comprising:

providing the leg assembly having a threaded connector secured to the member of the frame of the product, a linkage member pivotally coupled to the threaded connector to form a pivot joint having a pivot axis therebetween, and a leg member rotatably and slideably coupled to the linkage member in a coaxial arrangement to define a linkage assembly, the leg member having a threaded inner surface adjacent to an upper end and being configured to threadably couple to the threaded connector;

pivoting the linkage assembly from a folded position wherein the linkage member is substantially parallel to the member of the frame about the pivot axis of the pivot joint to align an axis of the linkage assembly with an axis of the threaded connector;

sliding the leg member upwardly towards the threaded connector secured to the member of the frame disposing a portion of the linkage member and a portion of threaded connector within the leg member; and rotating the leg member about the threaded connector until the upper end of the leg assembly abuts the member of the frame, threadably coupling the leg member to the threaded connector.

19. The method of claim 18, wherein pivoting the linkage assembly about the pivot axis of the pivot joint includes pivoting the linkage assembly at least 90 degrees about the pivot axis of the pivot joint.

20. The method of claim 18, wherein sliding the leg member upwardly towards the threaded connector secured to the member of the frame includes telescopically receiving the linkage member, the portion of the threaded connector, and the pivot joint within a cavity of the leg member.

* * * * *